US009096052B2

(12) United States Patent
Gila et al.

(10) Patent No.: US 9,096,052 B2
(45) Date of Patent: Aug. 4, 2015

(54) PRINTERS, METHODS, AND APPARATUS TO FORM AN IMAGE ON A PRINT SUBSTRATE

(75) Inventors: Omer Gila, Cupertino, CA (US); Daihua Zhang, Palo Alto, CA (US); Yossi Rosen, Sitriya (IL); Ilanit Mor, Kiryat Ono (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 77 days.

(21) Appl. No.: 13/981,561

(22) PCT Filed: Jan. 31, 2011

(86) PCT No.: PCT/US2011/023231

§ 371 (c)(1),
(2), (4) Date: Jul. 24, 2013

(87) PCT Pub. No.: WO2012/105948

PCT Pub. Date: Aug. 9, 2012

(65) Prior Publication Data

US 2013/0305942 A1 Nov. 21, 2013

(51) Int. Cl.

| | |
|---|---|
| ***G03G 15/10*** | (2006.01) |
| ***B41F 16/00*** | (2006.01) |
| ***G03G 15/00*** | (2006.01) |

(52) U.S. Cl.

CPC ..... *B41F 16/0006* (2013.01); *G03G 15/6585* (2013.01)

(58) Field of Classification Search

CPC ..... B41F 16/0006; G03G 15/6585

USPC ..... 399/223, 231, 233, 237

See application file for complete search history.

(56) References Cited

U.S. PATENT DOCUMENTS

| | | | |
|---|---|---|---|
| 4,945,387 | A | 7/1990 | Landa et al. |
| 5,028,964 | A | 7/1991 | Landa et al. |
| 5,047,808 | A | 9/1991 | Landa et al. |
| 5,089,856 | A | 2/1992 | Landa et al. |
| 5,157,238 | A | 10/1992 | Landa et al. |
| 5,286,948 | A | 2/1994 | Landa et al. |
| 5,335,054 | A | 8/1994 | Landa et al. |
| 5,497,222 | A | 3/1996 | Landa et al. |
| 5,554,476 | A | 9/1996 | Landa et al. |

(Continued)

FOREIGN PATENT DOCUMENTS

| | | |
|---|---|---|
| JP | 1993-281863 | 10/1993 |
| JP | 08-039772 | 2/1996 |

(Continued)

OTHER PUBLICATIONS

International Searching Authority, "International Search Report", issued in connection with PCT Application No. PCT/US2011/023231, mailed Oct. 24, 2011 (4 pages).

(Continued)

*Primary Examiner* — William J Royer
(74) *Attorney, Agent, or Firm* — Chad A Pahnke

(57) ABSTRACT

Printers, methods, and apparatus to form an image on a substrate are disclosed. An example apparatus to form an image on a print substrate includes an applicator to apply a first material, an ink developer to apply a plurality of ink particles, and a transfer cylinder to transfer the ink particles and the first material to a print substrate to form an image and a coating.

19 Claims, 8 Drawing Sheets

(56) References Cited

U.S. PATENT DOCUMENTS

| | | | | |
|---|---|---|---|---|
| 5,636,349 | A | 6/1997 | Landa et al. | |
| 6,316,120 | B1 | 11/2001 | Emslander | |
| 6,438,352 | B1 | 8/2002 | Landa et al. | |
| 6,539,191 | B2 * | 3/2003 | Itaya | 399/237 |
| 6,887,558 | B2 | 5/2005 | Simpson et al. | |
| 6,986,977 | B2 * | 1/2006 | Ishii et al. | 399/237 |
| 7,092,667 | B1 | 8/2006 | Landa et al. | |
| 7,274,902 | B2 | 9/2007 | Holstun et al. | |
| 7,364,800 | B2 | 4/2008 | Jesberger et al. | |
| 7,648,756 | B2 | 1/2010 | Cooper | |
| 7,754,106 | B2 | 7/2010 | Mikhael et al. | |
| 7,767,294 | B2 | 8/2010 | Cooper | |
| 2007/0031751 | A1 | 2/2007 | Teishev et al. | |
| 2009/0097883 | A1 | 4/2009 | Guzman et al. | |
| 2009/0110887 | A1 | 4/2009 | Sanada et al. | |

FOREIGN PATENT DOCUMENTS

| | | |
|---|---|---|
| JP | 09-156137 | 6/1997 |
| JP | 2000-267448 | 9/2000 |
| JP | 2005-031197 | 2/2005 |
| JP | 2010-211077 | 9/2010 |
| KR | 10-19990074369 | 10/1999 |
| KR | 10-20100010910 | 2/2010 |

OTHER PUBLICATIONS

International Searching Authority, "Written Opinion", issued in connection with PCT Application No. PCT/US2011/023231, mailed Oct. 24, 2011 (3 pages).

* cited by examiner

PRINTERS, METHODS, AND APPARATUS TO FORM AN IMAGE ON A PRINT SUBSTRATE

BACKGROUND

Offset printing is a printing technique that uses an intermediate transfer, or offset, between an image plate and a print substrate on which the image is to be formed. Offset printing may be accomplished in sheet-fed (i.e., one sheet fed at a time) or web-fed (i.e., a continuous sheet of substrate is fed) configurations.

BRIEF DESCRIPTION OF THE DRAWINGS

Wherever possible, the same reference numbers will be used throughout the drawing(s) and accompanying written description to refer to the same or like parts.

DETAILED DESCRIPTION

Figure 1A:
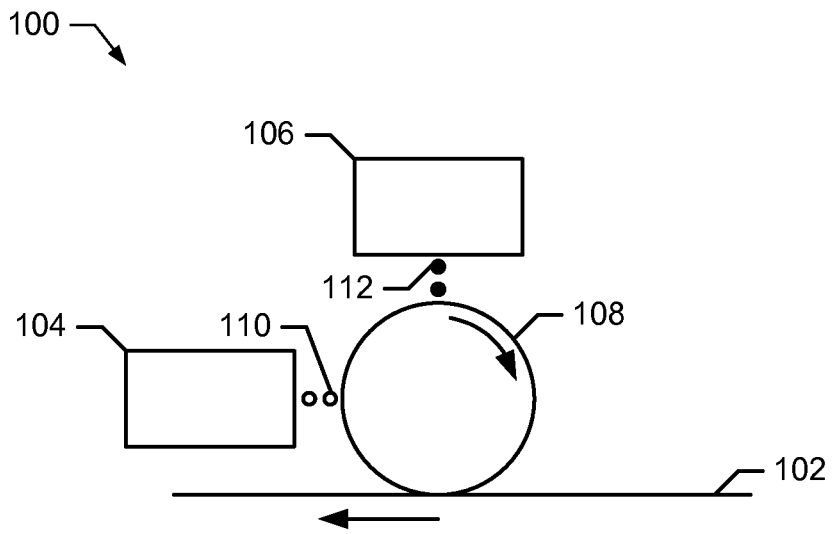
FIG. 1A is a block diagram of an example printer to form an image on a print substrate in accordance with teachings disclosed herein.

Ink adhesion and image durability are factors that designers and users of printers consider. One of several ways to improve image durability is to provide a coating over the image printed on a print substrate. However, the application of known coatings, such as varnish, over images can reduce the speed of printing (e.g., printer throughput), which can also be an important factor in end user satisfaction. To apply known coatings requires separate coating devices and additional drying systems, which add manufacturing and operating costs to the printer and require additional space within the printer. Known coatings are also relatively thick and may not work with particular substrates.

Known blankets (e.g., blanket drums) tend to have dot gain, or the tendency for the dot area in a printed image to increase and/or decrease as more impressions are performed. Additionally, known blankets suffer from contamination as the impressions increase. Both dot gain and ink contamination contribute to decreased image quality as known blankets are used.

Example methods and apparatus disclosed herein reduce or eliminate background contamination of images, improve scratch resistance of images, and/or improve the useful life of the blanket. In some tests, the useful life of the blanket improved by a factor of 5× (e.g., from about 80,000 impressions to over 400,000 impressions in an example test). Additionally, in some examples, even after hundreds of thousands of impressions, the blanket avoids developing image memory because, in one-shot mode, the ink does not come into direct contact with the blanket and, in four-shot mode, a coating material cleans ink from the blanket with each image. As used herein, printing in "one-shot" mode refers to applying ink particles from a transfer member to a print substrate in one transfer. Printing in "four-shot" mode, as used herein, refers to applying four layers of ink particles to a print substrate via a transfer member in four transfers. While some examples disclosed herein are described with reference to four-shot mode, the methods and apparatus disclosed herein are equally applicable to different numbers of "shots" or transfers to apply ink particles to a substrate. Example methods and apparatus disclosed herein substantially maintain gloss and dot area, which also maintains high print quality.

Example printers and apparatus disclosed herein include an applicator to apply a coating material. They also include an ink developer to apply a plurality of ink particles. Such example printers and apparatus further include a transfer cylinder to transfer the ink particles and the coating material to a print substrate to form an image and a coating over the image. Some example printers and apparatus further include a photo imaging surface to which the coating material and/or the ink particles are applied. The coating material and/or the ink particles may then be applied to the print substrate via the transfer cylinder and/or a transfer member such as a rubber blanket.

FIG. 1A is a block diagram of an example printer 100 to form an image on a print substrate 102. The example printer 100 illustrated in FIG. 1A includes an applicator 104, an ink developer 106, and a transfer cylinder 108. The printer 100 may operate in a one-shot mode, in which ink and a coating material accumulate on a transfer member while disengaged from paper, and the transfer cylinder 108 transfers the accumulated ink to the print substrate 102 after engaging the transfer cylinder 108.

The applicator 104 of the illustrated example applies (e.g., to the transfer cylinder 108 or to a photo imaging surface) a first material 110. The first material 110 may be, for example, a polymer coating or a transparent ink (e.g., Electro Ink, available from Hewlett-Packard). The ink developer 106 applies an ink 112 (e.g., to the transfer cylinder 108, to another cylinder, or to the first material 110. The first material 110 and the ink 112 are transferred to the print substrate 102 to form an image (e.g., via the ink 112) on the print substrate 102, and a coating (e.g., via the first material 110) over the image to protect the image from damage. In some examples, the ink developer 106 is implemented using an electrophotographic engine.

Figure 1B:
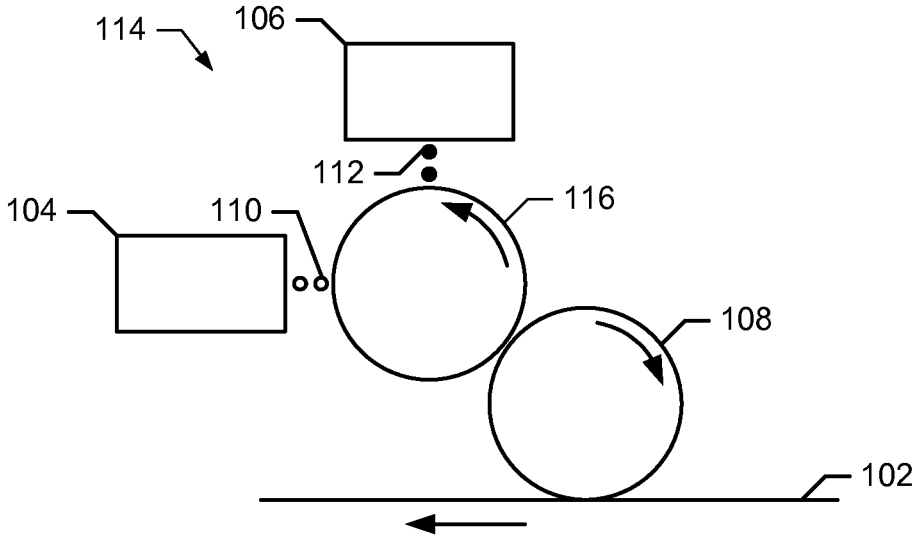
FIG. 1B is a block diagram of another example printer to form an image on a print substrate in accordance with teachings disclosed herein.

FIG. 1B is a block diagram of another example printer 114 to form an image on the print substrate 102. The example printer 114 illustrated in FIG. 1B includes the example applicator 104, the example ink developer 106, and the example transfer cylinder 108 described above. The example printer 114 of FIG. 1B further includes a photo imaging surface 116. In the example of FIG. 1B, the applicator 104 and the ink developer 106 apply the first material 110 and the ink 112, respectively, to the photo imaging surface 116. The photo imaging surface 116 then transfers the first material 110 and the ink 112 to the print substrate 102 via the transfer cylinder 108. More detailed examples of the example printers 100, 114 of FIGS. 1A and 1B operating in one-shot or four-shot modes are described below. While some examples are described in detail as operating in one-shot or four-shot modes, the example printers 100, 114 of FIGS. 1A and 1B are not limited to one mode of operation and, instead, may be operated in either or both of one-shot mode or four-shot mode.

Figure 2:
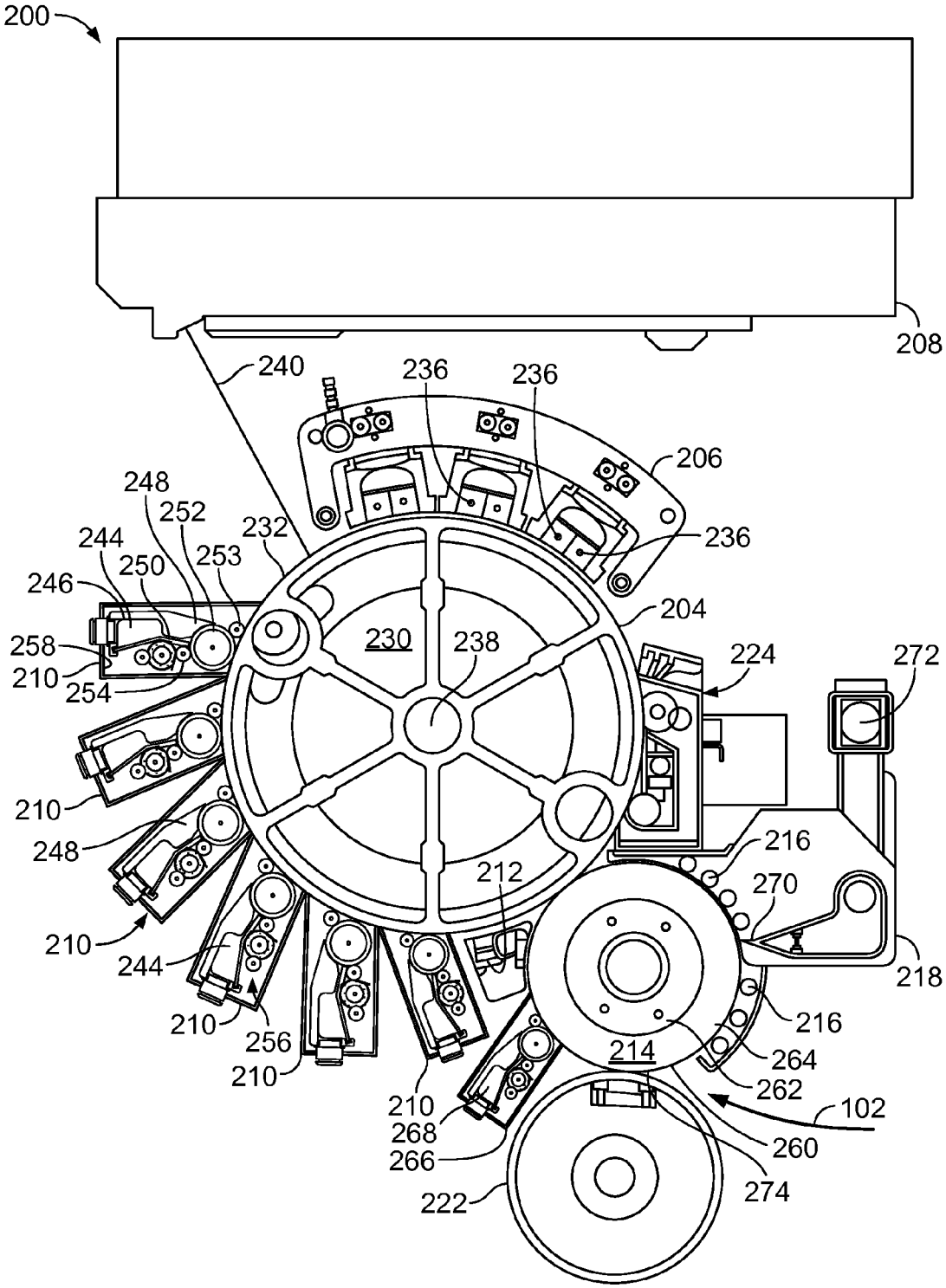
FIG. 2 is a schematic illustration of an example printer to form an image on a print substrate using a one-shot mode in accordance with teachings disclosed herein.

FIG. 2 is a schematic illustration of an example imaging system or printer 200 configured to form an image upon a print substrate 102. The example printer 200 may be used to implement an offset color press. The printer 200 of FIG. 2 includes a photo imaging surface 204 (e.g., a photoconductor), a charger 206, an imager 208, developer units 210, a charge eraser 212, an intermediate transfer member 214, an external heating system 216, a dryer 218, an impression cylinder 222 and a cleaning station 224. The photo imaging surface 204 of the illustrated example includes a cylindrical drum 230 supporting a photo imaging plate (PIP) or some other type of electrophotographic surface 232. The electrophotographic surface 232 is a surface that may be electrostatically charged and selectively discharged upon receiving light from the imager 208. Although the surface 232 of FIG. 2 is illustrated as being supported by the drum 230, the surface 232 may alternatively be implemented as an endless belt supported by a plurality of cylinders. In such an example, the exterior surface of the endless belt may be electrostatically charged and selectively discharged to create a latent image in the form of an electrostatic field.

The example charger 206 of FIG. 2 electrostatically charges the surface 232. This provides a background electrostatic charge, which may be substantially uniform, across the surface 232. In the illustrated example, the charger 206 includes six corotrons or scorotrons 236. A more detailed description of a charger that may be used to implement the charger 206 may be found in U.S. Pat. No. 6,438,352, the full disclosure of which is hereby incorporated by reference. However, other devices for electrostatically charging the surface 232 may additionally or alternatively be employed.

The example imager 208 of FIG. 2 may be implemented using any device configured to direct light upon the surface 232 so as to form an image. In the example shown, the imager 208 comprises a scanning laser which is moved across the surface 232 as the photo imaging surface 204 is rotated about an axis 238. Those portions of the surface 232 which are impinged by the light or laser 240 discharge the background electrostatic charge to form a latent image upon the surface 232. The portions of the surface 232 that are not impinged by the laser 240 maintain their respective background electrostatic charge. The imager 208 may additionally or alternatively be implemented using any other device(s) to selectively emit or selectively allow light to impinge upon the surface 232. For example, the imager 208 may include one or more shutter devices which employ liquid crystal materials and/or devices including individual micro or nano light-blocking shutters to alternate between the light blocking and light transmitting states.

In some examples, the surface 232 may include an electrographic surface including an array of individual pixels configured to be selectively charged or selectively discharged using an array of switching mechanisms such as transistors or metal-insulator-metal (MIM) devices forming an active array or a passive array for the array of pixels. In these examples, the charger 206 and the imager 208 may be omitted.

The example developer units 210 apply ink(s) 244 (or other printing material) to the surface 232 based on the electrostatic charge on the surface 232 and develop the image on the surface 232. In other words, those areas of the surface 232 that have been discharged by the laser 240 will receive and retain ink(s) 244 whereas those with the background charge will not. In the illustrated example of FIG. 2, the ink 244 is a liquid or fluid ink including a liquid carrier and colorant particles. The colorant particles may have a size of less than 1 micron (micrometers, μm), although in some examples the particle size may be different. In the illustrated example, the ink 244 generally includes approximately 2% by weight, colorant particles or solids prior to being applied to the surface 232. In some examples, the ink 244 is Hewlett-Packard Electro Ink, which is commercially available from Hewlett-Packard.

In the example of FIG. 2, each developer unit 210 generally includes a toner chamber 246, a main electrode 248, a back electrode 250, a developer roller 252, a cleaning roller 253, a squeegee roller 254, a developer cleaning system 256, and a reservoir 258. The toner chamber 246 includes a cavity having an inlet through which printing material is supplied from the reservoir 258 to the toner chamber 246 and between the main electrode 248 and the developer roller 252. The main electrode 248 and the back electrode 250 are situated opposite to the developer roller 252 and may be electrically charged. In the illustrated example, the back electrode 250 has a dielectric tip opposite the developer roller 252 and cooperates with the main electrode 248 to form the toner chamber 246.

The example developer roller 252 of the illustrated example is rotatably driven and electrically charged to a voltage distinct from the voltage of electrode 248 so as to attract electrically charged ink particles or colorant particles of the ink 244 as the developer roller 252 is rotated. The developer roller 252 is charged such that the charged ink particles being carried by the developer roller 252 are further attracted and drawn to those portions of the surface 232 that are electrostatically charged. The cleaning roller 253 removes excess ink 244 from the surface of the developer roller 252. In some examples, the squeegee roller 254 may be selectively charged to control the thickness or concentration of the ink 244 on the surface of the developer roller 252. In the illustrated example of FIG. 2, the developer roller 252 and the squeegee roller 254 are appropriately charged so as to form a substantially uniform 6 micron thick film that is composed of approximately 20% solids on the surface of the developer roller 252 and is substantially transferred to the electrophotographic surface 232.

The developer cleaning system 256 of the illustrated example removes ink 244 from the developer roller 252 that has not been transferred to the electrophotographic surface 232. The removed ink 244 is mixed and pumped back to a reservoir 258 in which colorant particles or solid content of the liquid or fluid is precisely monitored and controlled. An example developer unit that may be used to implement the developer units 210 is discussed in U.S. Pat. No. 6,438,352, the full disclosure of which is hereby incorporated by reference.

The charge eraser 212 of the illustrated example is disposed along the electrophotographic surface 232 and is to remove residual charge from the surface 232. In some examples, the charge eraser 212 is implemented by a light-emitting diode (LED) erase lamp. The intermediate transfer member 214 of the illustrated example transfers the ink 244 from the surface 232 to the print substrate 102. The intermediate transfer member 214 of FIG. 2 includes an exterior transfer surface 260 which is resiliently compressible and may be electrostatically charged. Because the transfer surface 260 is resiliently compressible, the surface 260 conforms and/or adapts to irregularities on the print substrate 102. Additionally, because the surface 260 is configured to be electrostatically charged, the surface 260 may be charged to a voltage to facilitate the transfer of ink 244 from the electrophotographic surface 232 to the transfer surface 260. In some examples, the surface 260 has a compressibility that reduces the likelihood of damage caused by permanent deformation of the surface 260.

In the illustrated example of FIG. 2, the intermediate transfer member 214 includes a drum 262 and an external blanket 264. The example drum 262 is a cylinder that supports the blanket 264, and is constructed using material(s) having a relatively low thermal conductivity and/or heat resistance. The example blanket 264 of the illustrated example wraps about the drum 262 and includes the surface 260. The example blanket 264 is constructed using a resiliently compressible layer and an electrically conductive layer, which enable the transfer surface 260 to conform and to be electrostatically charged. In some examples, the intermediate transfer member 214 includes an endless belt supported by a plurality of cylinders, including a transfer cylinder, in contact and/or in close proximity to the electrophotographic surface 232 and the impression cylinder 222.

The heating system 216 of the illustrated example is external to the transfer surface 260 of the intermediate transfer member 214 and applies heat to the ink 244 being carried by the transfer surface 260 from the photo imaging surface 204 to the print substrate 102. The heat provided by the heating system 216 drives off and/or evaporates carriers or solvents of the liquid printing material, such as Isopar. The example heating system 216 of FIG. 2 also applies sufficient heat energy to the ink 244 to partially melt and blend solids and/or colorant particles of ink 244, thereby forming a hot adhesive liquid plastic.

In the example of FIG. 2, an applicator 266, or coating developer, is positioned adjacent the example intermediate transfer member 214. The example applicator 266 of FIG. 2 is positioned prior to the transfer point between the photo imaging surface 204 and the intermediate transfer member 214 to apply a material 268 (e.g., a polymer) directly to the transfer surface 260 prior to the transfer of the ink 244 from the photo imaging surface 204. The example applicator 266 illustrated in FIG. 2 is implemented using an additional developer unit similar or identical to the example developer units 210. The example applicator 266 applies the material 268 as a uniform coating across the width of the transfer surface 260. The photo imaging surface 204 of the illustrated example then transfers the developed ink 244 onto the coating material 268 covering the surface 260 instead of applying the ink 244 directly to the surface 260.

The dryer 218 of the illustrated example facilitates partial drying of the ink 244 on the transfer surface 260. The example dryer 218 is positioned adjacent the intermediate transfer member 214 to direct air towards the surface 260 and to withdraw air from the surface 260. In the illustrated example, the dryer 218 forces air through an exit slit 270, which forms an air knife, and withdraws or sucks air via an exit port 272.

The example impression cylinder 222 of FIG. 2 is a cylinder located adjacent to the intermediate transfer member 214 so as to form a nip 274 between the intermediate transfer member 214 and the cylinder 222. The print substrate 102 is fed between the intermediate transfer member 214 and the impression cylinder 222. The ink 244 is transferred from the intermediate transfer member 214 to the substrate 102 at the nip 274. Although the impression cylinder 222 is illustrated as a cylinder, the impression cylinder 222 may alternatively be implemented using an endless belt and/or a stationary surface against which the intermediate transfer member 214 moves.

The example cleaning station 224 of FIG. 2 is positioned proximate to the photoelectrographic surface 232 between the intermediate transfer member 214 and the charger 206. The cleaning station 224 of the illustrated example removes residual ink and electrical charge from the surface 232

In operation using one-shot mode, the photo imaging surface 204 accumulates the desired layer(s) and/or color(s) of the ink 244 on the intermediate transfer member (e.g., the coating over the surface 260) to form an image. In particular, before any layers of ink 244 are applied to the transfer surface 260, the applicator 266 applies a substantially even layer of the coating material 268 to the surface 260.

To apply a layer of the ink 244, the charger 206 of the illustrated example electrostatically charges the electrophotographic surface 232. The surface 232 is then exposed to the laser 240, which is controlled by a raster image processor that converts instructions from a digital file into on/off instructions for the laser 240. This controlled application of laser light to the surface results in a latent image being formed on the electrostatically discharged portions of the surface 232. The ink developer units 210 develop an image upon the surface 232 by applying ink 244 to those portions of surface 232 that remain electrostatically charged.

Once an image upon the electrophotographic surface 232 has been developed, the charge eraser 212 of the illustrated example erases any remaining electrical charge on the surface 232 and the ink image is transferred to the transfer surface 260. However, rather than transferring the developed ink 244 to the transfer surface 260 directly, in the illustrated example the ink 244 is applied to the coating material 268 that covers the transfer surface 260. The charging, developing, discharging, and transfer from the electrophotographic surface 232 to the transfer surface 260 is then repeated for additional ink layers in preparation for the final image to be transferred to the print substrate 102.

When the inks have been transferred to the transfer surface 260, the heating system 216 of the illustrated example applies heat to the ink 244 on the surface 260 to evaporate the carrier liquid of the ink 244 and/or to melt toner binder resin of the colorant particles or solids of the ink 244 to form a hot melted adhesive. The dryer 218 dries the melted liquid colorant particles. The surface 260 is then rotated to transfer the layer of melted colorant particles forming the image to the print substrate 102 passing between the intermediate transfer member 214 and the impression cylinder 222. The layer of melted colorant particles adheres to the print substrate 102 on contact in the nip 274 and forms the desired image on the print substrate 102.

Due to the layering of the coating material 268 and the ink 244 on the intermediate transfer member 214, in the example of FIG. 2 the ink 244 is applied to the print substrate 102 and the coating material 268 is applied in an even layer over the print substrate 102. By applying the coating material 268 to the print substrate 244, the coating material 268 is substantially completely removed from the surface 260. The applicator 266 then applies another coating to the transfer surface 260 for the next image. In this manner, the coating material 268 protects the transfer surface 260 and the blanket 264 from image memory and small dot transfer in one-shot mode.

Figure 3:
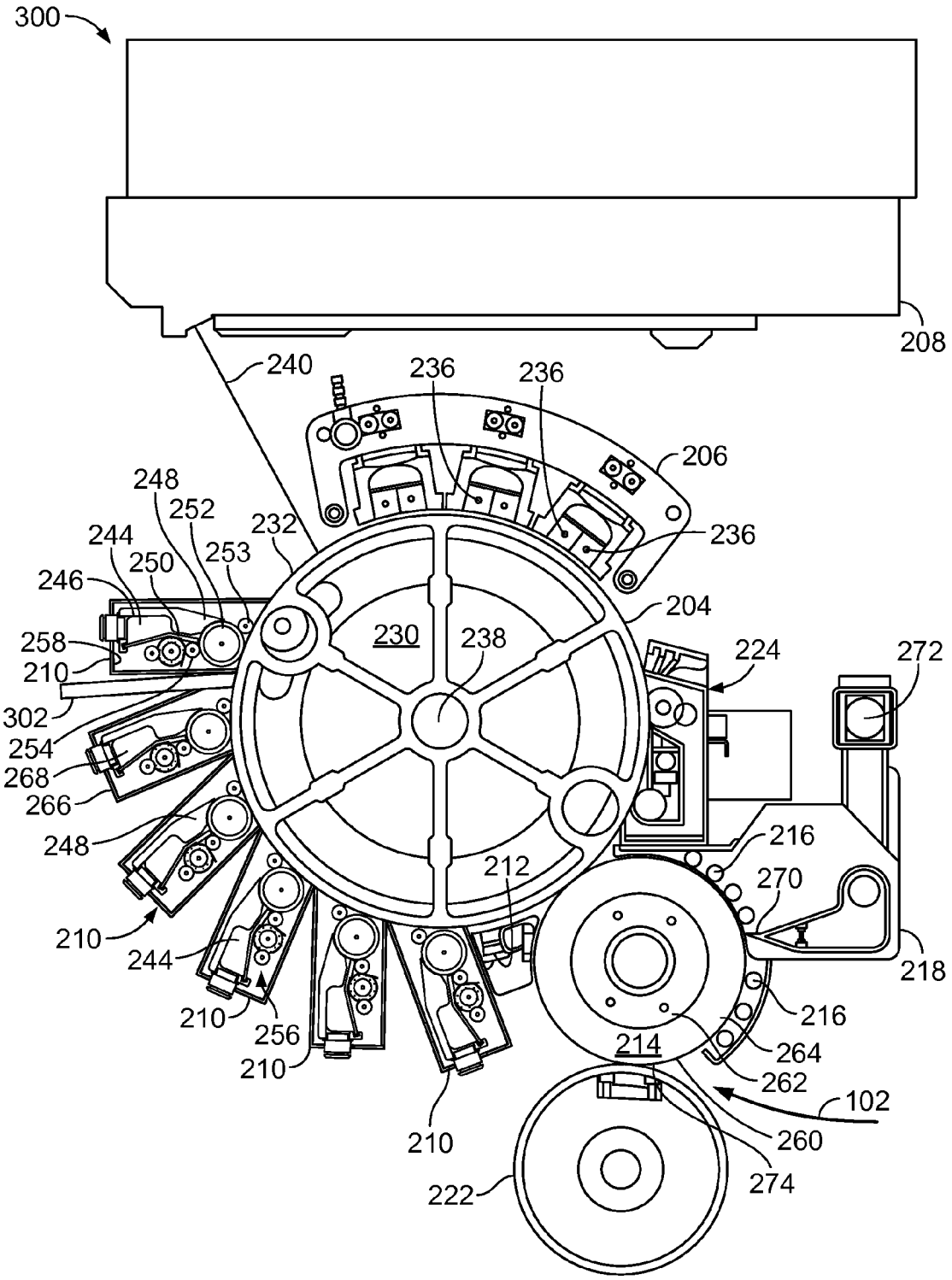
FIG. 3 is a schematic illustration of an example printer to form an image on a print substrate using a four-shot mode in accordance with teachings disclosed herein.

FIG. 3 is a schematic illustration of an example printer 300 to form an image on a print substrate 102 using a four-shot mode. The example printer 300 includes the example photo imaging surface 204 (e.g., a photoconductor), the example charger 206, the example imager 208, the example developer units 210, the example charge eraser 212, the example intermediate transfer member 214, the example external heating system 216, the example dryer 218, the example impression cylinder 222 and the example cleaning station 224 described above in conjunction with FIG. 2. However, the example printer 300 is different from the printer 200 in that the example applicator 266 of FIG. 3 is implemented using one of the developer units 210 (e.g., by replacing ink in the developer unit 210 with the coating material) instead of including an additional applicator 266 adjacent the intermediate transfer member 214. As a result, the example printer 300 is able to use one less supplementary ink color for printing. However, for many printing applications the reduced color set will not significantly affect print quality.

In the illustrated example printer 300 of FIG. 3, the applicator 266 is located in place of the second developer unit 210 of FIG. 2 (as the photo imaging surface 204 rotates counterclockwise). During each impression cycle (e.g., ink color layer or rotation of the photo imaging surface 204), the appropriate developer unit 210 applies to the photo imaging surface 204 one of the colored inks (e.g., black, cyan, magenta, yellow) to be used in creating the image on the print substrate 102. The printer 300 performs an impression cycle for each of the colored inks that are to be used to create the image on the print substrate 102. After the appropriate developer unit 210 applies a colored ink to the electrophotographic surface 232, the electrophotographic surface 232 transfers the colored ink to the intermediate transfer member 214, which transfers the ink to the print substrate 102. In the four-shot mode of the illustrated example, the colored inks accumulate on the print substrate 102 instead of the intermediate transfer member 214.

If the applicator 266 were to use an additional impression cycle to apply the coating after the ink(s) 244 had been applied, the throughput of the example printer 300 would be reduced significantly because each print would require one additional impression cycle. This would result in a 25% decrease in throughput for four-color prints, a 20% decrease in throughput for five-color prints, etc.

To avoid the reduction in throughput, the example applicator 266 of FIG. 3 applies the coating material 268 to the photo imaging surface 204 during the same impression cycle as one of the colored inks 244 is applied (e.g., the final impression cycle for a print), thereby saving an extra impression cycle and maintaining the throughput of the printer 300.

As described above, the charger 206 applies a background charge (e.g., −950 Volts (V)) to the electrophotographic surface 232, which is reduced in certain areas by the laser 240 to form a latent image on the electrophotographic surface 232. The locations where the laser 240 does not write maintain the background charge. After the developer unit 210 applies the ink to the areas forming the latent image, a charge eraser 302 erases the background charge and the charge adjacent the ink 244 on the photoconductor 204 (e.g., to about −50 V). The charge eraser 302 may be constructed using, for example, a light bar including addressable light-emitting polymers (LEPs), a corona charging unit, and/or any other suitable type of eraser lamp. In the example of FIG. 3, the charge eraser 302 is provided in addition to the charge eraser 212. The ink 244 remains fixed to the photoconductor 204 after the charge eraser 302 erases the background charge on the photoconductor 204.

After the charge eraser 302 erases the charge, the applicator 266 of the illustrated example develops or applies the coating material over the ink on the electrophotographic surface 232 to form an even or substantially even layer of the coating material 268. The drum 230 then turns to apply the coating material 268 and the ink 244 to the intermediate transfer member 214 (e.g., the transfer surface 260, the blanket 264, etc.). Because the coating material 268 is applied to the electrophotographic surface 232 after the ink 244, the coating material 268 is applied to the surface 260 between the ink 244 and the surface 260 (similar to the layering configuration in the one-shot mode described above) when the coating material 268 and the ink 244 are applied to the surface 260. The coating material 268 therefore protects the surface 260 from at least one layer of the ink 244. Additionally, the coating material 268 may clean the surface 260 by removing ink particles or droplets from layers of the ink 244 that contacted the surface 260 directly. In this manner, the coating material 268 extends the useful life of the surface 260 and lengthens the time until adverse imaging effects occur due to the surface 260.

When the intermediate transfer member 214 applies the ink and the coating to the print substrate, the ink is applied to the print substrate and the coating material is applied over the ink (and any previously-applied ink layers) to coat and protect the image.

Figure 4:
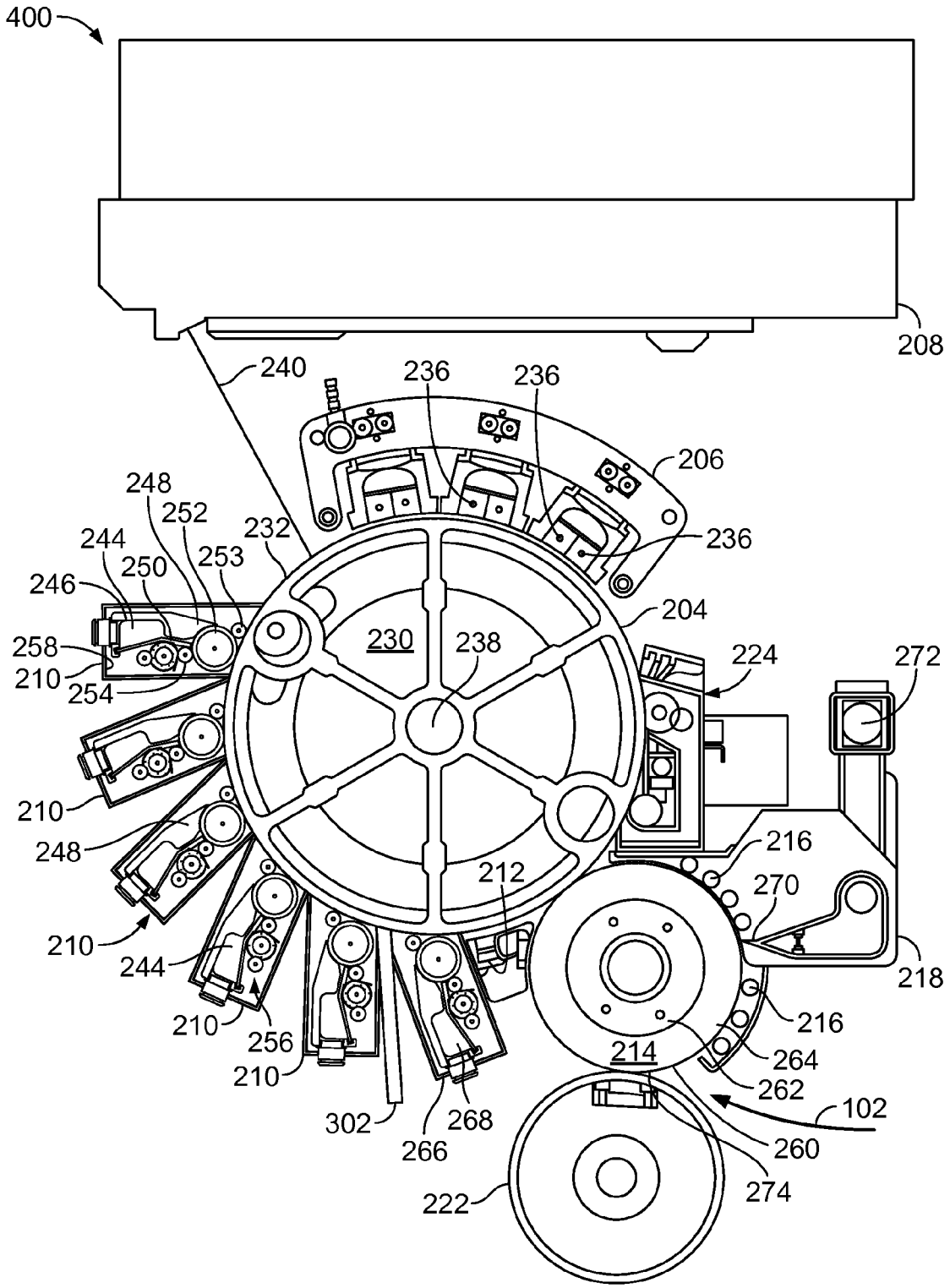
FIG. 4 is a schematic illustration of another example printer to form an image on a print substrate using a four-shot mode in accordance with the teachings herein.

FIG. 4 is a schematic illustration of another example printer 400 to form an image on a print substrate 102 using a four-shot mode. Like the example printer 300 of FIG. 3, the example printer 400 illustrated in FIG. 4 uses the four-shot mode by accumulating the ink on the substrate instead of the intermediate transfer member 214. The example printer 400 includes the example photo imaging surface 204 (e.g., a photoconductor), the example charger 206, the example imager 208, the example developer units 210, the example charge eraser 212, the example intermediate transfer member 214, the example external heating system 216, the example dryer 218, the example impression cylinder 222 and the example cleaning station 224 described above in conjunction with FIG. 2.

Unlike the printer 300 of FIG. 3, however, the example printer 400 of FIG. 4 implements the applicator 266 in the place of the last developer unit 210 in the rotational direction of the drum 230 (e.g., counterclockwise) and implements the charge eraser 302 immediately prior to the applicator 266. Because the applicator 266 of FIG. 4 is positioned after the developer units 210 and the charge eraser 302 is positioned immediately before the applicator 266, the example charge eraser 212 of FIG. 2 may be omitted.

As described above, the example applicator 266 applies the coating material to the electrophotographic surface 232 during the same impression cycle as one of the ink colors. Inks are applied to the print substrate 102, one at a time, via the electrophotographic surface 232 and the intermediate transfer member 214. During the impression cycle for the final color for the image to be printed on the print substrate 102, the example applicator 266 applies the coating material 268. To apply the coating material 268, after the final color for the image is applied to the electrophotographic surface 232 in a desired pattern, the charge eraser 302 erases the background charge on the surface 232. The applicator 266 then applies the coating material 268 to the electrophotographic surface 232.

FIGS. 5A-5D illustrate an example accumulation of ink and coating on an example transfer member 502 (e.g., the transfer surface 260 of FIGS. 2-4) to form an image on a print substrate (e.g., the print substrate 102 of FIGS. 1A-4) in a one-shot mode. In the one-shot mode, the applicator 266 applies the coating material (e.g., the coating material 110, 268 of FIGS. 1A-4) to the transfer member 502 before application of ink(s). The ink(s) (e.g., the ink(s) 112, 244 of FIGS. 1A-4) that form the image on a print substrate 102 are then applied to the coating material 110, 268. The transfer member 502 may be a rubber blanket such as the blanket 264 described above in conjunction with FIG. 2, and may be used to implement the transfer cylinder 108 of FIG. 1A. An example method to apply the coating material 110, 268 and ink(s) 112, 244 to the transfer member 502 and to the print substrate 102 is described below with reference to FIG. 7.

Figure 5A:
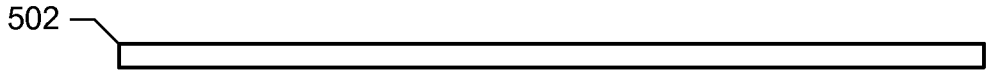
FIGS. 5A-5D illustrate an example transfer member accumulating layers of ink and coating to form an image on a print substrate in a one-shot mode.
Figure 5B:
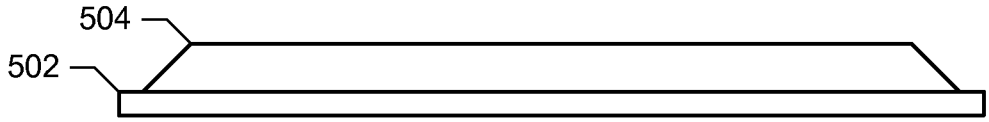

FIG. 5A illustrates the transfer member 502 prior to applying the coating material or the inks. FIG. 5B illustrates the transfer member 502 after the applicator 266 of FIG. 2 applies a coating material 504 (e.g., a polymer) to the transfer member 502. In the illustrated example, the applicator 266 applies an even or substantially even layer of the coating material 504 to the transfer member 502. The coating material 504 is to be removed completely or substantially completely from the transfer member 502 when the transfer member 502 makes the impression of the ink(s) and the coating material 504 on a print substrate.

Figure 5C:
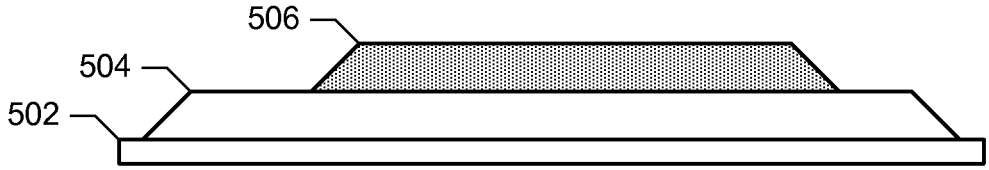
Figure 5D:
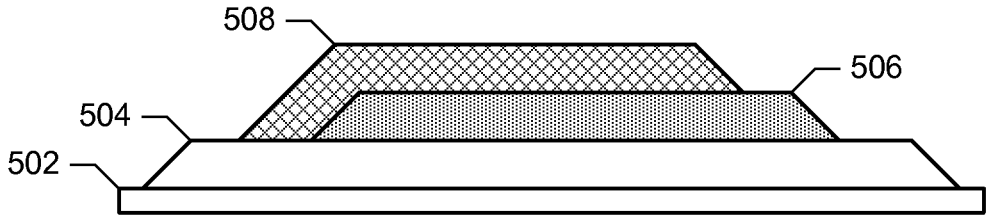

FIG. 5C illustrates the transfer member 502 after the photo imaging surface 204 (e.g., the electrophotographic surface 232) of FIG. 2 has applied a first layer of ink 506 to the coating material 504. FIG. 5D illustrates the transfer member 502 after the photo imaging surface 204 has applied another layer of ink 508 to the coating material 504. As illustrated in FIG. 5C, the coating material 504 protects the transfer member 502 from the ink 506 and 508. When the transfer member 502 transfers the ink and the coating material 504 to a print substrate, the ink(s) 506 and 508 will contact the print substrate and the coating material will cover the ink(s) 506 and 508 with a protective layer.

When making the impression, the coating material 504 and the ink(s) 506 and 508 will be completely or substantially completely transferred from the transfer member 502 to the print substrate. As a result, the transfer member 502 may again be represented by the illustration in FIG. 5A. The example applicator 266 then applies another layer of the coating material 502 to prepare the transfer member 502 for another impression.

Figure 6A:
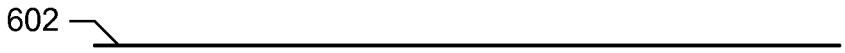
FIGS. 6A-6D illustrate an example print substrate accumulating layers of ink and coating to form an image on the print substrate in a four-shot mode.

FIGS. 6A-6D illustrate an example accumulation of ink and coating on a print substrate 602 to form an image on the print substrate 602 in a four-shot mode. In the illustrated example, ink(s) and coating material are applied to the print substrate 602 by accumulating the layer(s) of ink(s) 112, 244 and layer(s) of coating material 110, 268 to the print substrate 602 from a photo imaging plate (e.g., the photo imaging surface 204, the electrophotographic surface 232 of FIGS. 2-4, etc.) via a transfer member (e.g., the blanket 264 of FIGS. 2-4). FIG. 6A illustrates the example print substrate before the ink(s) or the coating material are applied. An example method to form an image on a print substrate in a four-shot mode is described below with reference to FIG. 8.

Figure 6B:
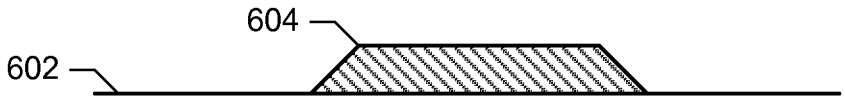
Figure 6C:
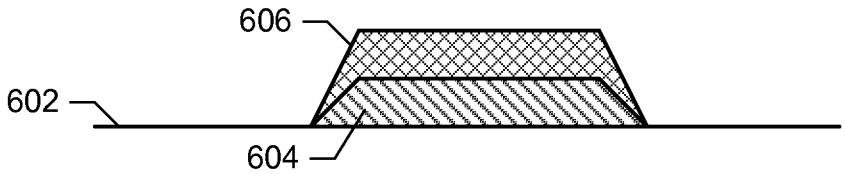

FIG. 6B illustrates the example print substrate 602 after a first layer of ink 604 is applied to the print substrate 602. For example, a developer unit 210 of FIGS. 3 and 4 may apply a color (e.g., cyan, magenta, yellow, etc.) to locations on the photo imaging surface 204 where a latent image is formed. The photo imaging surface 204 transfers the ink to a transfer member (e.g., the intermediate transfer member 214 of FIGS. 3 and 4), which in turn transfers the ink to the print substrate 602. FIG. 6C illustrates the example print substrate 602 after a second layer of ink 606 is applied to the print substrate 602. The second layer of ink 606 may be applied in a manner similar to the method used to apply the first layer of ink 604.

Figure 6D:
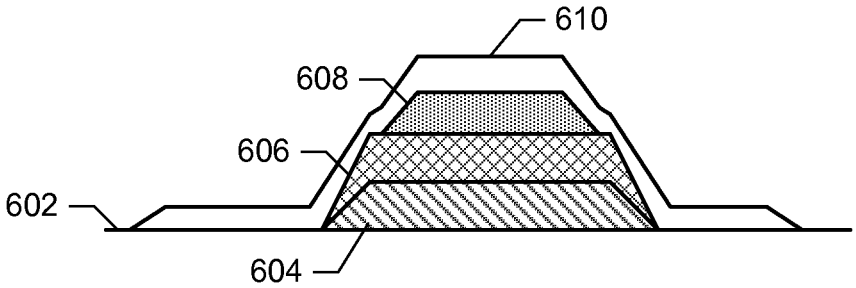

FIG. 6D illustrates the example print substrate 602 after a final layer of ink 608 and a coating material 610 have been applied. The example ink 608 and the coating material 610 may be applied at the same time as described above in conjunction with FIGS. 3 and 4 to increase the printing throughput.

Figure 7:
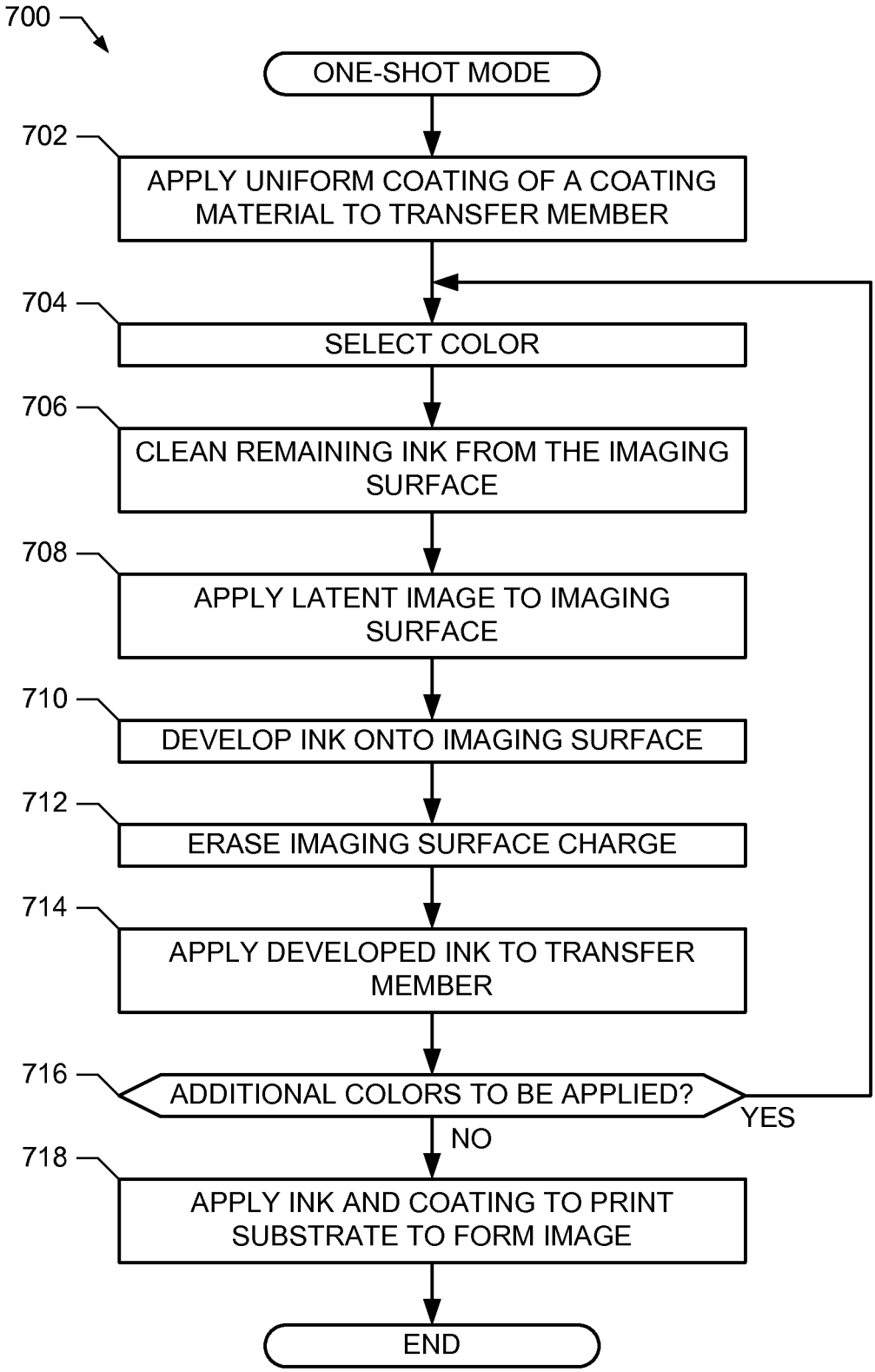
FIG. 7 depicts a flowchart representative of an example method to form an image on a print substrate in a one-shot mode.

FIG. 7 depicts a flowchart representative of an example method 700 to form an image on a print substrate in a one-shot mode. The example method of FIG. 7 may be used to implement the printers 200, 300, 400 of FIGS. 2-4 to form an image on a print substrate. The method 700 may be advantageously used in web-fed presses that use continuous or substantially continuous sheets of print substrate.

The example method 700 may begin at the beginning of a printing process and/or after a previous image has been formed to (e.g., printed to) a print substrate (e.g., the print substrate 102 of FIGS. 1A-4). FIG. 5A illustrates an example state of a transfer member 502 at the beginning of the method 700. An applicator (e.g., the applicator 266 of FIG. 2) applies a uniform or substantially uniform coating of a coating material (e.g., a polymer) to a transfer member (e.g., the intermediate transfer member 214, the blanket 264, and/or the transfer surface 260 of FIG. 2) (block 702). FIG. 5B illustrates an example state of the transfer member 502 after block 702.

The printer 200 selects (e.g., based on raster data of a desired image) a color of ink (e.g., cyan, magenta, yellow, black) to be included in the desired image (block 704). The selected ink may be developed by one of the developer units 210 of FIG. 2 for eventual application to a print substrate 102 as a part of an image. During the example method 700, a photo imaging surface (e.g., the photo imaging surface 204 the drum 230, and/or the electrophotographic surface 232 of FIG. 2) rotates to facilitate several functions as described herein. A photoconductor cleaning station 224 removes ink from the electrophotographic surface 232 that remains from previous impression cycles (block 706). Cleaning the electrophotographic surface 232 in this manner improves the image quality.

A charge device (e.g., the laser 240 of FIG. 2) applies a latent image to the photoconductor 204 (block 708). For example, the laser 240 forms the latent image by charging (or discharging) the electrophotographic surface 232 to a voltage different than the background voltage. The developer unit 210 associated with the determined ink color develops (e.g., applies) ink 244 onto electrophotographic surface 232 (block 710). For example, the developer unit 210 may develop the ink 244 such that the ink 244 is attracted to the electrophotographic surface 232 wherever the latent image has been formed. To facilitate the transfer of the ink 244 from the electrophotographic surface 232 to the transfer surface 260, a charge eraser (e.g., the charge eraser 212 of FIG. 2) erases a charge on the photoconductor 204 (block 712). By erasing the charge, the charge eraser 212 allows the ink to be transferred off of the electrophotographic surface 232 when contacted by the transfer surface 260. The example ink 244 adheres to the photoconductor 204 on contact (e.g., from the developer unit 210) and remains adhered to the photoconductor 204 after the charge eraser 212 removes the charge.

The electrophotographic surface 232 then applies the developed ink 244 to the transfer surface 260 (block 714). If there are additional colors to be applied to form the image (block 716), control returns to block 704 to select another color. If all of the colors(s) (e.g., all of the inks 244) that are to form the image have been applied (block 716), the transfer surface 260 transfers (e.g., applies) the ink 244 and the coating material 268 to a print substrate 102 to form an image (block 718). The example method 700 may then end and/or iterate to form another image on another sheet of print substrate 102 and/or another section of print substrate 102.

While the example method 700 is described above with reference to the printer 200 illustrated in FIG. 2, the method 700 may be modified to be performed by either of the example printers 300, 400 of FIGS. 3 and 4. To operate the example printers 300, 400 in one-shot mode, the example applicator 266 applies the coating material 268 to the electrophotographic surface 232 (instead of applying the coating material 268 to the transfer surface 260) after a developer unit 210 applies a first colored ink 244 to the electrophotographic surface 232 and the charge eraser 302 erases the background charge on the electrophotographic surface 232. The electrophotographic surface 232 then applies the coating material 268 and the first layer of ink 244 such that the coating material 268 is between the ink 244 and the transfer surface 260. The example method 700 may then continue by performing the example blocks 704-718 as described above to apply an image and the coating material 268 to a print substrate 102.

Figure 8:
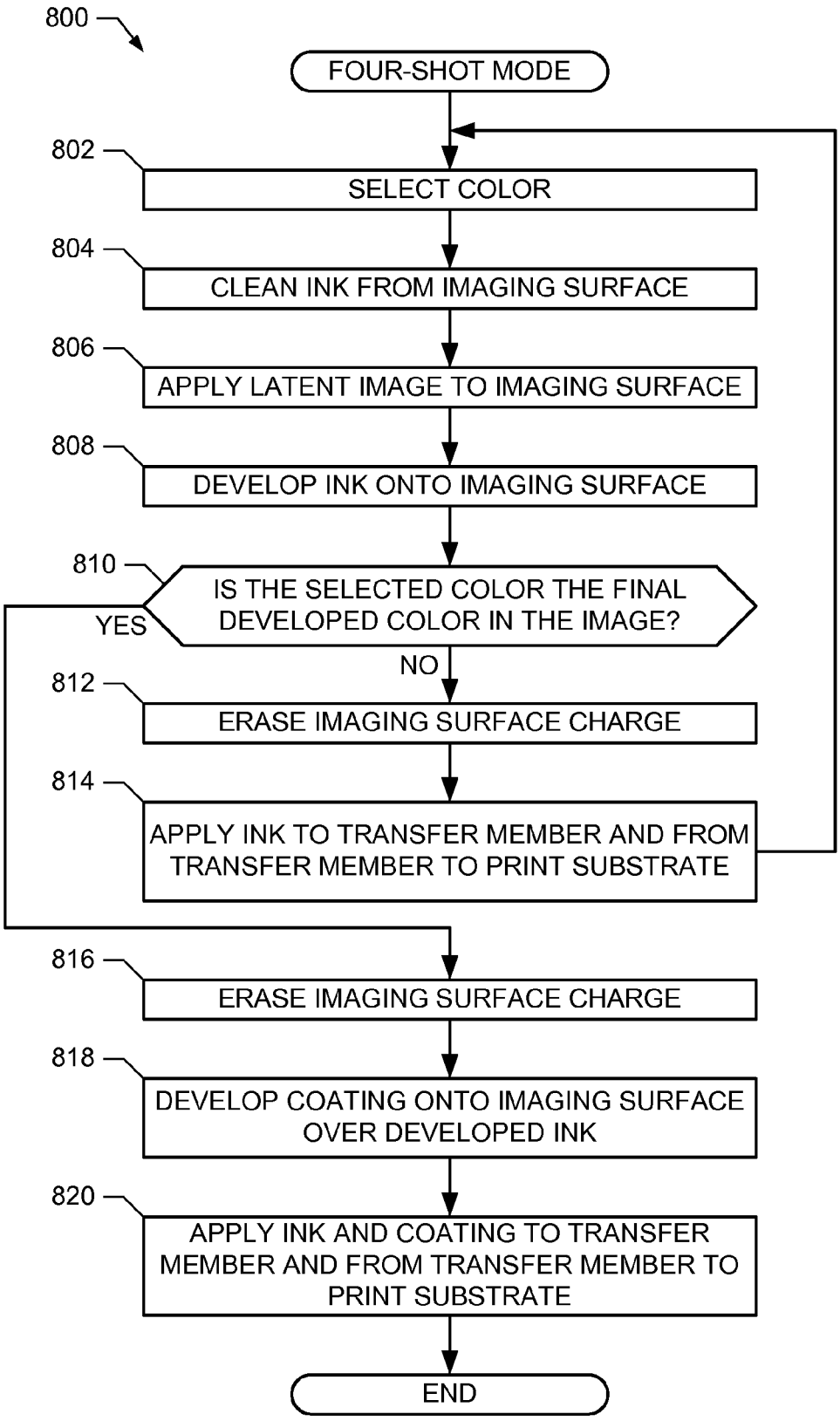
FIG. 8 depicts a flowchart representative of an example method to form an image on a print substrate in a four-shot mode.

FIG. 8 depicts a flowchart representative of an example method 800 to form an image on a print substrate (e.g., the print substrates 102, 602 of FIGS. 1-4 and 6) in a four-shot mode. The example method 800 may be used to implement the example systems 300 and 400 of FIGS. 3 and 4 to form an image on a print substrate. The method 800 may begin, for example, at the start of a printing process and/or between impressions of an image on a print substrate. In general, printing in four-shot mode includes transferring layers of ink, one at a time, to a print substrate (e.g., the print substrate 102, 602 of FIGS. 1-4 and 6) via the intermediate transfer member 214, and is advantageously used with sheet-fed printing processes.

To begin the method 800, a printer controller selects a color of ink 244 (e.g., cyan, magenta, yellow, black) to be included in the desired image (block 802). The selected ink 244 may be developed by one of the developer units 210 of FIGS. 3 and 4 for eventual application to a print substrate 102 as a part of an image. During the example method 800, a photo imaging surface 204 (e.g., the electrophotographic surface 232 and the drum 230 of FIGS. 3 and 4) rotates to facilitate several functions as described herein. A photoconductor cleaning station 224 removes ink from the electrophotographic surface 232 that may have remained from previous impression cycles (block 804).

A charge device (e.g., the laser 240 of FIGS. 3 and 4) applies a latent image to the electrophotographic surface 232 (block 806). For example, the laser 240 forms the latent image by charging (or discharging) the electrophotographic surface 232 to a voltage different than the background voltage. The developer unit 210 associated with the determined ink color develops ink 244 onto the electrophotographic surface 232 (block 808). If the developed ink 244 applied to the electrophotographic surface 232 (block 808) is not the final developed color in the image (e.g., other colors in the image have yet to be applied) (block 810), a charge eraser (e.g., the charge eraser 212 and/or the charge eraser 302 of FIGS. 3 and 4) erases the electrophotographic surface 232 charge (block 812). The electrophotographic surface 232 then applies the developed ink 244 to the intermediate transfer member 214 (e.g., the transfer surface 260 and/or the blanket 266 of FIGS. 3 and 4), which transfers the ink 244 to the print substrate 102 (block 814). Control then returns to block 802 to select the next color.

On the other hand, if the developed ink 244 applied to the photoconductor 204 is the final developed color in the image (e.g., all other colors in the image have been developed and applied to the transfer surface 260 and/or to the print substrate 102) (block 810), a secondary charge eraser (e.g., the charge eraser 302 of FIGS. 3 and 4) erases the charge from the photoconductor 204 (block 816). The secondary charge eraser 302 may be in addition to or an alternative to the charge eraser 212 illustrated in FIGS. 3 and 4, and the secondary charge eraser 302 may be included or omitted based on the location of the applicator 266. After erasing the charge from the electrophotographic surface 232, the applicator 266 develops and/or applies a coating to the electrophotographic surface 232 over the developed ink 244 (block 818). In some examples, the coating is a thin (e.g., about 1 micron thick) layer of a transparent material 268 such as a polymer and/or a transparent ink.

The electrophotographic surface 232 then applies the final layer of ink 244 and the layer of coating material 268 to the transfer surface 260, which transfers the ink 244 and the coating material 268 to the print substrate 102 (block 820). As described above, the ink 244 is transferred to the print substrate 102 and the coating material 268 is transferred to the print substrate 102 over the ink 244. As a result, the coating material 268 protects the ink 244 from damage.

While the example method 800 is described above with reference to the printers 300, 400 illustrated in FIGS. 3 and 4, the method 800 may be modified to be performed by the example printer 200 of FIG. 2. To operate the example printer 200 in four-shot mode, block 818 may be modified so the applicator 266 applies the coating material 268 to the transfer surface 260 prior to the electrophotographic surface 232 applying the final ink 244 (for an image) to the transfer surface 260, instead of applying the coating material 268 to the electrophotographic surface 232 after applying the final ink (for the image) to the electrophotographic surface 232. As a result, the coating material 268 is disposed between the final ink 244 and the transfer surface 260, and is then transferred to the print substrate 102 over the inks 244 to protect the image from damage.

The above-disclosed example methods and apparatus offer improved image durability, can substantially increase the useful life of a transfer member, and/or reduce undesirable effects in image quality resulting from transfer surfaces having high numbers of impression cycles. Additionally, example methods and apparatus disclosed above provide higher flexibility in selection of inks, selection of coatings, and/or selection of printing methods.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. An apparatus to form an image on a print substrate, comprising:

an ink developer to apply ink particles to a photo imaging surface;

an applicator to apply a first material to the ink particles and to the photo imaging surface such that the ink particles are between the first material and the photo imaging surface; and a transfer cylinder to transfer the ink particles and the first material to a print substrate to form an image and a coating.

2. An apparatus as defined in claim 1, wherein the photo imaging surface is to apply the first material and the ink particles to the transfer cylinder such that the first material is between the ink particles and the transfer cylinder.

3. An apparatus as defined in claim 1, further including a charge eraser to reduce a charge on the photo imaging surface after the ink developer applies the ink particles and before the applicator applies the first material.

4. An apparatus as defined in claim 3, wherein the charge eraser is to erase a background charge from the photo imaging surface.

5. An apparatus as defined in claim 1, wherein the first material is at least one of a polymer or a transparent ink.

6. An apparatus as defined in claim 1, wherein the first material forms the coating and is less than about 1 micrometer thick when transferred to the print substrate.

7. An apparatus as defined in claim 1, wherein the applicator is to apply the first material to a transfer member and the transfer cylinder is to transfer the first material and the ink particles from the transfer member to the print substrate.

8. An apparatus as defined in claim 1, wherein the applicator includes a second ink developer.

9. An apparatus as defined in claim 1, further including a second ink developer to apply second ink particles to the photo imaging surface between the first ink particles and the first material.

10. An apparatus as defined in claim 9, wherein the second ink developer is positioned between the first ink developer and the applicator.

11. A method to form an image on a print substrate, comprising:

applying a layer of ink particles to a photo imaging surface;

after the applying of the layer of the ink particles to the photo imaging surface and before transferring the ink particles to a transfer member, applying a first material to the photo imaging surface;

transferring the layer of the ink particles and the first material to a transfer member; and transferring the layer of the ink particles and the first material to a print substrate to form an image and a coating.

12. A method as defined in claim 11, wherein the applying of the first material includes applying a layer of the first material directly to the transfer member.

13. A method as defined in claim 12, wherein the first material includes at least one of a polymer or a transparent ink.

14. A method as defined in claim 11, further including applying a second layer of ink particles to the first layer of ink particles and the photo imaging surface before applying the first material.

15. A method as defined in claim 11, further including erasing a charge on the photo imaging surface at a position immediately prior to a location at which applying the first material to the layer of ink particles and the photo imaging surface occurs.

16. A printer to form an image on a substrate, comprising:

a photo imaging surface to receive ink particles;

a transfer surface to receive the ink particles from the photo imaging surface and to transfer the ink particles to the substrate; and a first applicator to apply a coating material to the photo imaging surface such that a first layer of ink is between the coating material and the photo imaging surface, the transfer surface to transfer the coating material to the substrate.

17. A printer as defined in claim 16, further including a plurality of second applicators to apply corresponding layers of ink, including the first layer of ink, to the photo imaging surface prior to the first applicator applying the coating material.

18. A printer as defined in claim 17, further including a charge eraser positioned between the first applicator and the plurality of second applicators, the charge eraser to reduce a charge on the photo imaging surface after the plurality of second applicators apply the layers of ink and before the first applicator applies the coating material.

19. A printer as defined in claim 17, wherein the photo imaging surface is to rotate once for each of the corresponding layers of ink.

* * * * *